US005567027A

United States Patent [19]

McClung et al.

[11] Patent Number: 5,567,027

[45] Date of Patent: Oct. 22, 1996

[54] CABINET DRAWER LOCK

[75] Inventors: Duane G. McClung, Kalamazoo; Paul G. Dame, Holland, both of Mich.

[73] Assignee: Herman Miller, Inc., Zeeland, Mich.

[21] Appl. No.: 75,970

[22] Filed: Jun. 11, 1993

[51] Int. Cl.[6] ..... E05B 65/46

[52] U.S. Cl. ..... 312/219; 312/221

[58] Field of Search ..... 312/219, 215, 312/216, 217, 221, 222, 295

[56] References Cited

U.S. PATENT DOCUMENTS

| | | | |
|---|---|---|---|
| 681,155 | 8/1901 | Tobey . | |
| 683,852 | 10/1901 | Ferry et al. . | |
| 1,829,770 | 11/1931 | Tannewitz . | |
| 2,547,486 | 4/1951 | Page . | |
| 2,719,770 | 10/1955 | Roberts . | |
| 3,404,929 | 10/1968 | Wright et al. . | |
| 3,454,320 | 7/1969 | Olree . | |
| 3,521,939 | 7/1970 | Fall et al. . | |
| 3,767,280 | 10/1973 | McLaughlin . | |
| 3,799,638 | 3/1974 | Faiks . | |
| 3,815,389 | 6/1974 | Richards, Sr. . | |
| 3,866,993 | 2/1975 | Dean et al. . | |
| 3,881,793 | 5/1975 | Anderson . | |
| 3,900,236 | 8/1975 | Goulish et al. . | |
| 3,909,090 | 9/1975 | Breckner et al. | 312/217 |
| 3,936,108 | 2/1976 | Chitester . | |
| 4,168,103 | 9/1979 | Hagen . | |
| 4,239,309 | 12/1980 | De Fouw et al. . | |
| 4,246,769 | 1/1981 | McLaughlin . | |
| 4,272,138 | 6/1981 | Stark . | |
| 4,298,236 | 11/1981 | Laroche . | |
| 4,303,286 | 12/1981 | McClellan . | |
| 4,355,851 | 10/1982 | Slusser . | |
| 4,429,930 | 2/1984 | Blouin | 312/221 |
| 4,447,098 | 5/1984 | Parker . | |
| 4,453,787 | 6/1984 | Staropoli | 312/221 |
| 4,480,883 | 11/1984 | Young . | |
| 4,609,233 | 9/1986 | Walla . | |
| 4,637,667 | 1/1987 | Reid et al. . | |
| 4,705,326 | 11/1987 | Craig . | |
| 4,761,045 | 8/1988 | Piane . | |
| 4,768,844 | 9/1988 | Ludwig . | |
| 4,770,476 | 9/1988 | Lakso . | |
| 4,790,610 | 12/1988 | Welch et al. . | |
| 4,889,396 | 12/1989 | Mitchell et al. . | |
| 4,925,258 | 5/1990 | Ludwig et al. . | |
| 4,955,672 | 9/1990 | Pham . | |
| 4,966,423 | 10/1990 | Higuera et al. | 312/219 |
| 4,993,784 | 2/1991 | Dana et al. . | |
| 5,056,877 | 10/1991 | Westwinkel . | |
| 5,069,511 | 12/1991 | Swets et al. . | |
| 5,074,627 | 12/1991 | Broeders . | |

FOREIGN PATENT DOCUMENTS

| | | |
|---|---|---|
| 2365677 | 4/1978 | France . |
| 1945065 | 3/1971 | Germany . |
| 2932519 | 2/1981 | Germany . |
| 2182706 | 5/1987 | United Kingdom . |
| 2220026 | 12/1989 | United Kingdom . |

*Primary Examiner*—Peter M. Cuomo
*Assistant Examiner*—Janet M. Wilkens
*Attorney, Agent, or Firm*—Brinks Hofer Gilson & Lione

[57] ABSTRACT

A lock system for a container having a first side wall and a second side wall. The lock system comprises a first component supported on a first track which defines a path for the first component to move from a closed position to an open position. The lock system comprises a first locking bar movable from a first position to a second position allowing the first component to move along the first track to the open position. The lock system comprises a second component supported on a second track defining a path for the second component to move from a closed position to an open position. A second locking bar is movable from a first position to a second position allowing the second component to move along the second track to the open position. The lock system further comprises a locking mechanism movable along a ramp to a locking position preventing the first locking bar from moving from the first position to the second position and preventing the second locking bar from moving from the first position to the second position so that the first and second components are each locked in the closed position.

92 Claims, 4 Drawing Sheets

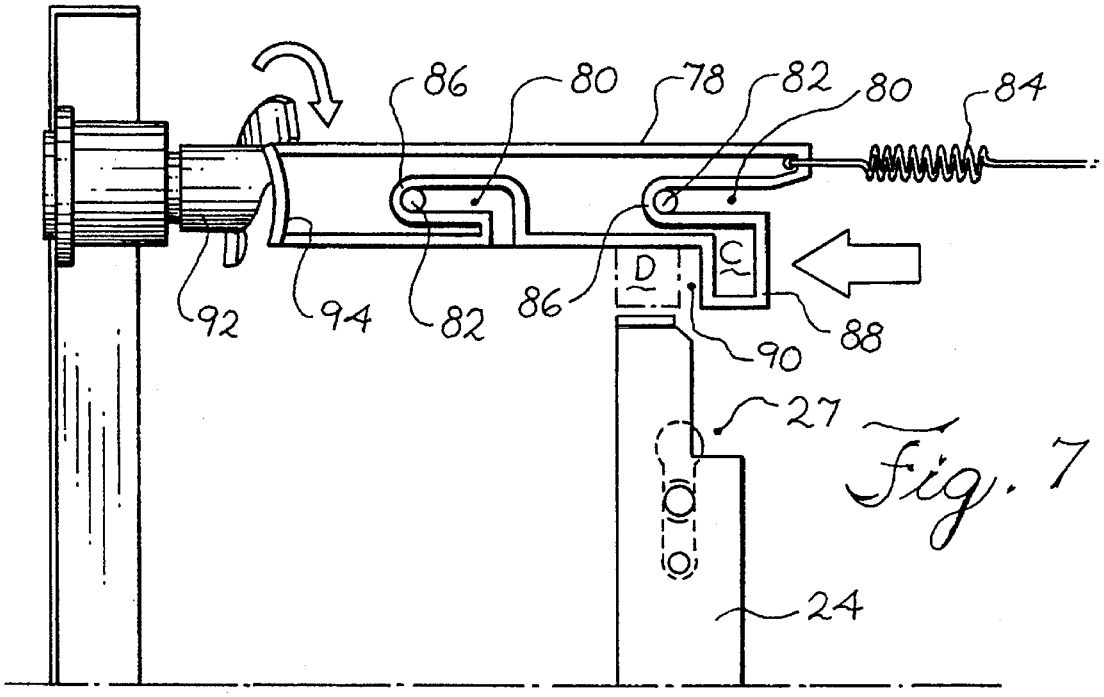
Fig. 7
Fig. 8
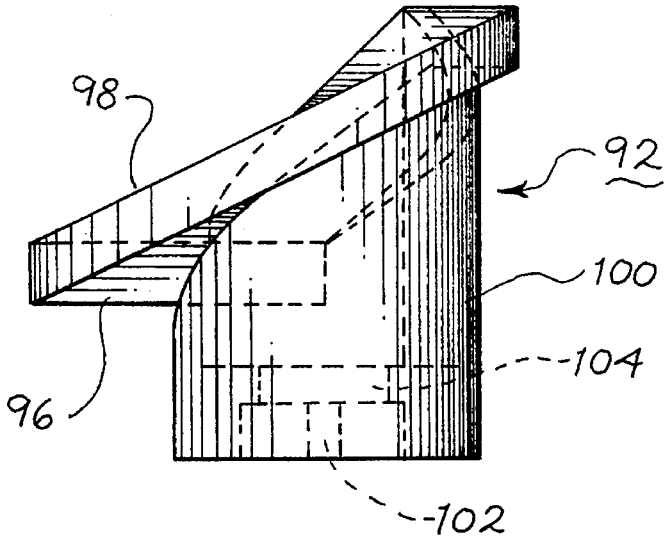

CABINET DRAWER LOCK

FIELD OF THE INVENTION

The present invention relates to a cabinet drawer lock for locking all drawers other than a drawer that is open. In another aspect of the invention, the present invention relates to a cabinet drawer lock for locking all of the drawers of a cabinet at once.

BACKGROUND OF THE INVENTION

It is common to have a plurality of drawers or shelves in a cabinet or desk. It is often desirable to prevent selected drawers or shelves from being opened while a single drawer is opened. The prevention of the selected drawers or shelves from being opened helps prevent the accidental opening of those drawers or shelves which can lead to the tipping of the cabinet. It is common to use an interlock system between the selected drawers to prevent their opening, such as described in U.S. Pat. No. 3,404,929 to Wright et al., U.S. Pat. No. 3,866,993 to Dean et al., and U.S. Pat. No. 3,881,793 to Anderson, It is an object of the present invention to provide a more efficient and less complicated cabinet locking system for locking selected drawers or cabinets.

It is also desirable to lock all of the drawers or shelves in their closed position to secure the contents thereof from unauthorized personnel. It is common to use an locking system to lock all of the drawers. However, such locking systems are usually involve complicated structures and a plurality of moving elements.

It is an object of the present invention to provide a locking system which is able to lock all of the drawers or shelves of a cabinet in a more efficient manner.

SUMMARY OF THE INVENTION

The above objects are accomplished in the present invention which is directed to a lock system for a container having a first side wall and a second side wall. The lock system comprises a first component supported on a first track which defines a path for the first component to move from a closed position to an open position. The lock system comprises a first locking bar movable from a first position to a second position allowing the first component to move along the first track to the open position. The lock system comprises a second component supported on a second track defining a path for the second component to move from a closed position to an open position. A second locking bar is movable from a first position to a second position allowing the second component to move along the second track to the open position. The lock system further comprises a locking mechanism movable along a ramp to a locking position preventing the first locking bar from moving from the first position to the second position and preventing the second locking bar from moving from the first position to the second position so that the first and second components are each locked in the closed position.

DETAILED DESCRIPTION OF DRAWINGS

FIG. 1 perspective view of a cabinet employing an embodiment of a lock system according to the present invention;

FIG. 7 is a side view of another locking mechanism according to the present invention; and FIG. 8 a side view of a helical cam used in the locking mechanism of FIG. 7.

DETAILED DESCRIPTION OF PREFERRED EMBODIMENT

Figures 1, 2:
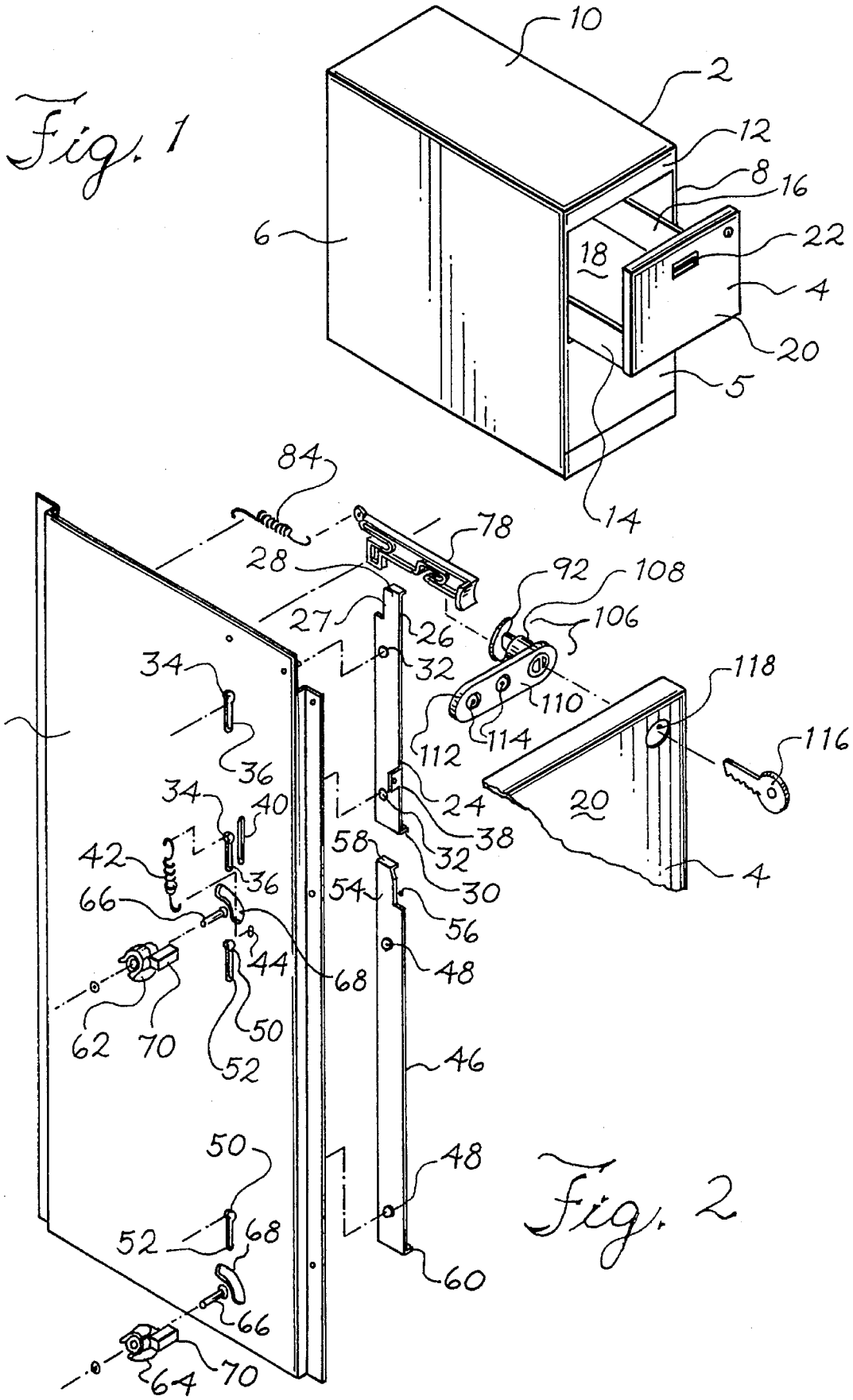
FIG. 2 is an exploded view of an embodiment of a lock system according to the present invention.

The present invention is best understood upon viewing a preferred embodiment illustrated in FIGS. 1–8. In FIG. 1 is generally shown a cabinet 2 having a plurality of drawers 4 and 5 arranged one above the other. The cabinet 2 employs a drawer locking system for locking selected drawers and/or locking all drawers according to the present invention. It is understood that the present invention is not limited to drawers, but may be used for other movable components which retract from an open position to a closed position, such as a shelf, and which support one or more objects. Furthermore, the present invention is not limited to just cabinets, but can be used in other container systems which employ one or more retractable components, such as a desk. Thus, in the description to follow a cabinet is taken to be any container having components which retract from an open position to a closed position. In FIG. 1, a rectangular cabinet 2 is shown having a left side surface 6 and a right side surface 8. Side surfaces 6 and 8 preferably have a double wall construction so as to contain the locking system of the present invention. The cabinet includes a top surface 10 and a bottom surface (not shown). In addition, the cabinet 2 includes a front surface 12 which defines an opening for the drawers 4 and 5 to move from an open to a closed position and vice versa. The cabinet further includes a back surface (not shown) wherein the side, bottom, top, front, and back surfaces are made of a resilient material, such as steel, wood, particle board, plastic, or structural urethane and are attached to each other in a well known manner, such as welding, nuts and bolts, screws, rivets, or adhesives. When the cabinet surfaces are attached, a space for receiving drawers 4 and 5 is defined. The size of the cabinet 2 is chosen according to the task for which it was intended.

In the cabinet 2 of FIG. 1, there are shown two drawers 4 and 5. Each drawer 4 and 5 comprises a first side wall 14, a second side wall 16, a bottom surface 18, a front surface 20, and a rear surface (not shown). The surfaces of the drawer are made of a resilient material, such as steel, wood, particle board, plastic, or structural urethane and are attached in a well known manner, such as welding, nuts and bolts, screws, rivets, or adhesives. It is understood that the size, shape, and the number of the drawers or shelves may vary depending on the intended use of the drawers or shelves.

The front surface 20 of each drawer 4 and 5 comprise a handle 22 which allows for one to easily to pull a drawer 4 or 5 from a closed position to an open position as shown in the top drawer of FIG. 1. The handle 22 also improves the ease of retracting an open drawer 4 or 5 to its closed position. The top and bottom drawers 4 and 5, respectively, of FIG. 1 are each supported on a pair of well known horizontal tracks 15 attached to the side walls. The tracks defines a path by which the drawers 4 and 5 move from a closed position to an open position and vice versa. Each track comprises a horizontal surface to allow the side edges of bottom surface 18 to slide along the track surface. It is also possible that drawers 4 and 5 have wheels or rollers attached to side walls 14 and 16 and which roll along the track surface. The above-mentioned structure for the drawers 4 and 5 and tracks is well known in the art and it is understood that the present invention would be applicable to other known systems for opening and closing drawers or shelves.

An embodiment of the lock system according to the present invention is shown in FIG. 2o The disclosure to follow discusses the lock system structure at the right side of cabinet 2. It is possible that the lock system can be applied to the left side of cabinet 2 as well or to both sides simultaneously. In particular, there is shown a top locking bar 24 which is associated with the top drawer. Top locking bar 24 is made of a sturdy material, such as 16 Ga cold rolled steel, and has a generally rectangular shape of approximately 7.50"×1.00"×0.060", as shown in FIG. 2. Integrally attached to the top of locking bar 24 is an L-shape contact element 26 having a length along the locking bar of approximately 1,122" and a width of approximately 0.593". Contact element 26 is positioned toward the front surface 20 so as to define an adjacent notch 27. Contact element 26 comprises a top flange 28 oriented perpendicular to the locking bar 24 and having dimensions of approximately 0.593"×0.250"×0,060". Note that the lengths of the locking bars are independent of the size of the drawers. Locking bar 24 further includes a bottom flange 30 integrally attached to the bottom and oriented parallel with flange 28. Bottom flange 30 has a generally rectangular shape having dimensions of 1.000"×0.250"×0.060".

Figure 3A:
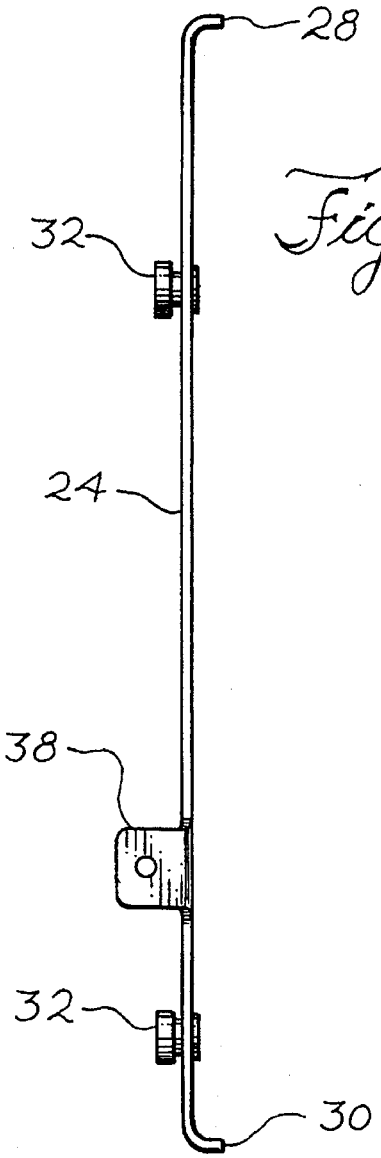
FIG. 3A is a side view of a first embodiment of a lock bar according to the present invention.

As seen in FIGS. 2 and 3A, locking bar 24 includes a pair of knobs 32 having a head portion and a neck portion. Knobs 32 are preferably located approximately 1.246" and approximately 5.746" from the bottom of locking bar 24. Locking bar 24 is slidably attached to right side surface 8 by inserting the knobs 32 in corresponding circular-like openings 34 as indicated by the dashed lines. At the bottom of openings 34 are slots 36 which allow the neck portions of knobs 32 to move therein. Each opening 34 has a diameter of approximately 0.360" and each slot 36 has a length of approximately 1.0" and a width of approximately 0.250" so as to slidably engage the neck portions of knobs 32. Furthermore, locking bar 24 is coupled to side surface 8 by having a generally rectangular tab 38 inserted through slot 40 located on side surface 8. Slot 40 has a length of approximately 1.650" and a width of approximately 0.150" so as to snugly receive tab 38. Slot 40 generally parallel to bottom slot 36 and is offset by approximately 0.470" from bottom slot 36. Furthermore, the top of slot 40 is located approximately 0.413" above the top of bottom slot 36.

A spring 42 is attached at one end to an opening of tab 38 and attached at the other end to an opening or slot 44 located on side surface 8. Spring 42 acts as a return spring so as to return top lock bar 24 and knobs 32 to the bottom of slots 36. Spring 42 has a sufficient stiffness that when lock bar 24 moves to the bottom of slot 36 all other locking bars below top locking bar 24 are forced to the bottom of their respective slots. Thus, spring 42 helps prevent all locking bars from being "hung up" in their top vertical position. Once attached to the right side surface 8, the locking bar 24 is able to vertically travel a distance of approximately 0.425" from a first position located at the bottom of the slot 36 to a second position located above the first position.

Figure 3B:
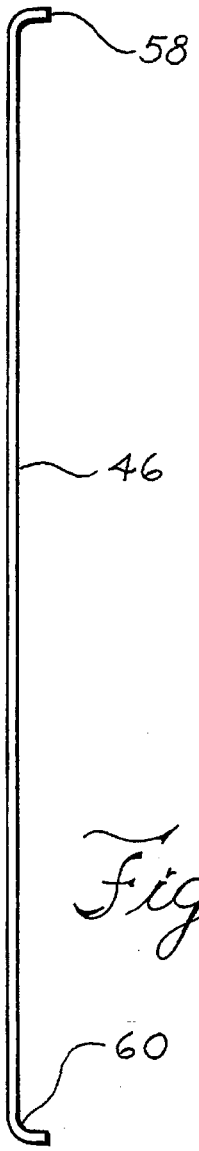
FIG. 3B is a side view of a second embodiment of a lock bar according to the present invention.

Aligned with and below top locking bar 24 is locking bar 46 which corresponds to the drawer located below the top drawer. As seen in FIG. 2, locking bar 46 is similar to top locking bar 24 in shape and in material. As with top locking bar 24, locking bar 46 slidably engages right side 8 via knobs 48 inserted in circular openings 50 and slots 52 having approximately the same dimensions as knobs 32, openings 34, and slots 36, respectively, as shown in FIG. 3B. Knobs 48 are preferably located approximately 1.246" and approximately 9.746" from the bottom of locking bar 38. Locking bar 46 has dimensions of approximately 12.0"×1.0"×0.06". Integrally attached to the top of locking bar 46 is an L-shape contact element 54 having a length along the locking bar of approximately 1.122" and a width of approximately 0.593". Contact element 54 is positioned away from the front surface 20 so as to define an adjacent notch 56 located nearest the front surface 20. Contact element 54 comprises a top flange 58 oriented perpendicular to the locking bar 46 and having dimensions of approximately 0.437"×0.250"×0.060". Locking bar 46 further includes a bottom flange 60 having a shape and orientation similar to bottom flange 30 of locking bar 24. Once attached to the right side surface 8, locking bar 46 is able to vertically travel a distance of approximately 0.425" from a first position located at the bottom of the slot 52 to a second position located above the first position.

Figure 4:
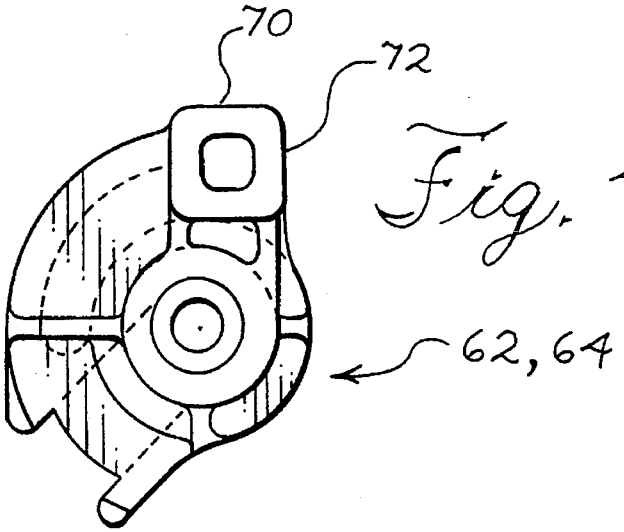
FIG. 4 is a front view of a rotatable cam according to the present invention.

With the above-described locking bars 24 and 46, it is possible to automatically lock all drawers other than a drawer already opened. This type of locking is accomplished by a locking mechanism associated with each drawer 4 or 5, such as rotatable top cam 62 and bottom cam 64, as shown in FIG. 4. Each cam 62, 64 is made of a resilient material, such as plastic, and is attached to right side surface 8 by pins 66 located below the lowest of the pair of slots 36 and 52. Each pin 66 is located approximately 0,204" further away from the front surface 20 than the corresponding slot and is located approximately 1,387" below the bottom of the nearest slot.

Each pin 66 defines the center of curvature for an approximately 90° curved slot 68. Each slot 68 has an inner radius of curvature of approximately 0.296" and a width of approximately 0,454". The slot 68 is sized and positioned such so that it receives a generally rectangular lug 70 attached to either cam 62 or 64. As seen in FIG 4, rectangular lug 70 has a length of approximately 0.300" and a generally rectangular cross-section 72 to be inserted into slot 68. Cross-section 72 has a height of approximately 0.343" and a width of approximately 0,376". Once lug 70 of cam 62 or 64 is inserted into a corresponding slot 68, cam 62 or 64 is capable of rotating by approximately 90°. Rotation of cams 62 and 64 is accomplished by providing an engagement element, such as pin 74, on a side of the drawer 4 or 5 which engages with cams 62 or 64. Pin 74 is located approximately 0,605" above the bottom surface 18 of the drawer and approximately 5.013" from the front surface 22 of the drawer. Pin 74 engages with cams 62 or 64 by entering a female slot portion 76 positioned at approximately 45° degrees with respect to lug 70.

Figure 5:
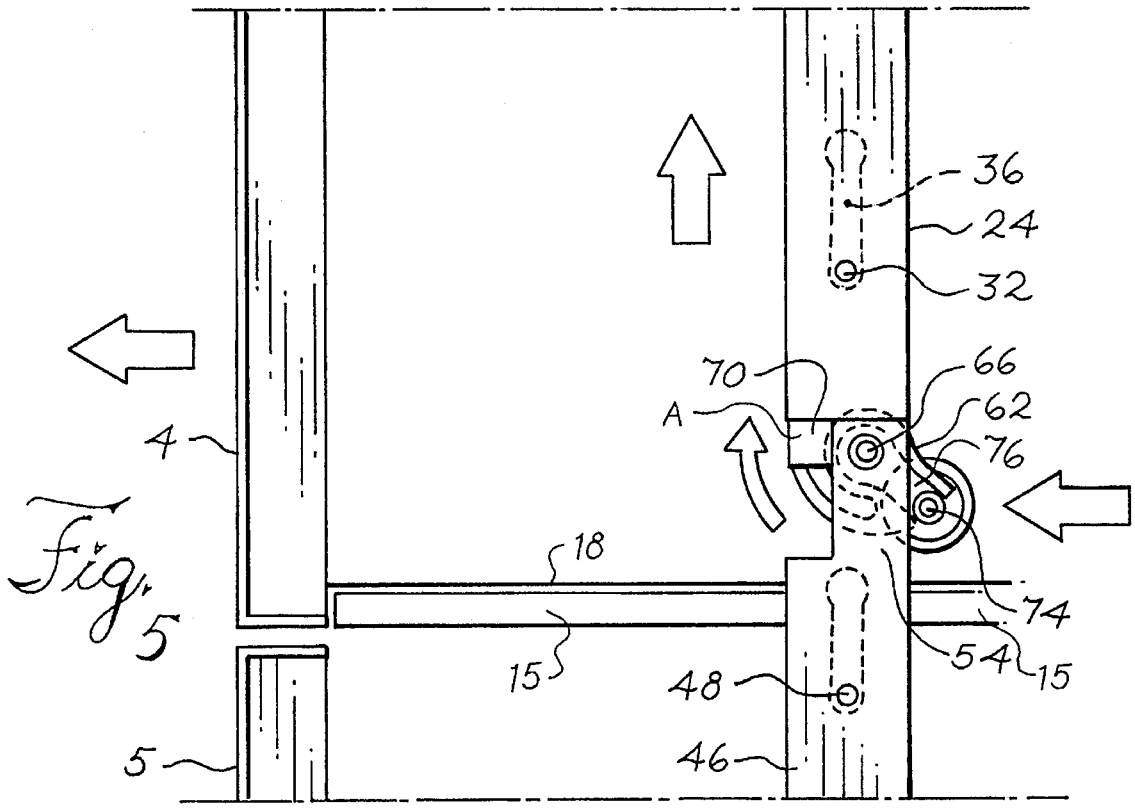
FIG. 5 is a side view of an embodiment of a locking mechanism in an unlocked position according to the present invention.
Figure 6:
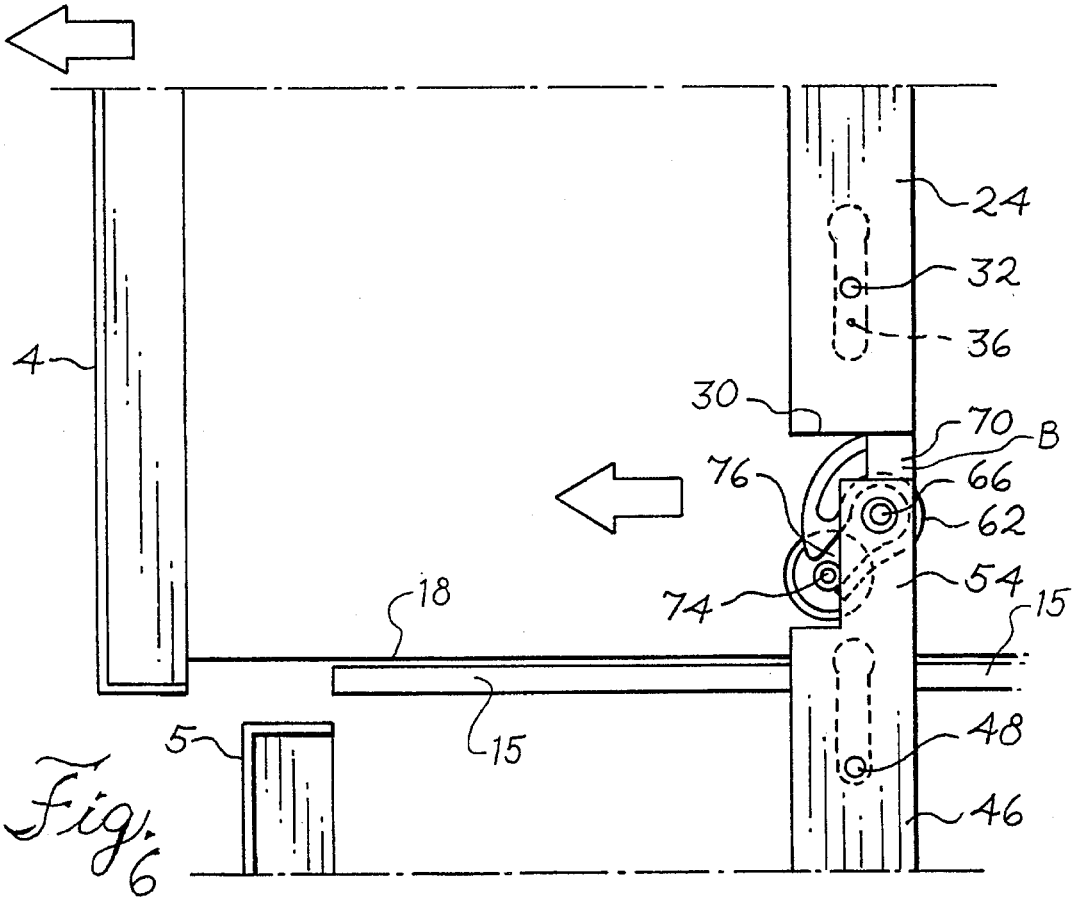
FIG. 6 is a side view the embodiment of the locking mechanism FIG. 5 in a locked position.

With the above description of the elements of the locking system in mind, one is able to understand one aspect of the present invention by observing the operation of the embodiment of FIGS. 1–6 as the top drawer is opened. In FIG. 5, as top drawer 4 is opened (indicated by horizontal arrow) pin 74 enters slot portion 76. Further movement of top drawer 4 results in pin 74 engaging cam 62 through slot portion 76 resulting in cam 62 rotating counterclockwise by approximately 90°. During this rotation, lug 70 engages the bottom flange 30 of locking bar 24 resulting in locking bar 24 moving upwards as shown by the vertical arrow of FIG. 6. This rotation results in lug 70 rotating from position A, wherein the lug 70 lies in the notch of the locking bar, to locking position B as shown in FIGS. 5–6.

At locking position B two events occur. In FIG. 6, the slot portion 76 of top cam 62 has rotated to an extent that pin 74 is able to disengage from the slot portion 76. This allows the top drawer 4 to continue on to the open position shown in FIG. 1. The second event occurring at position B is that lug 70 lies directly over the top flange 58 of locking bar 46 of the bottom drawer effectively locking the bottom drawer in the closed position. The locking of bottom drawer 5 is due to the fact that when the pin 74 of bottom drawer 5 engages the bottom cam 64, cam 64 is unable to rotate because lug 70 is unable to move bottom flange 60 of locking bar 46 upwards. This is due to the fact that when lug 70 of the top cam 62 is at position B, locking bar 46 is unable to move vertically. When locking bar 46 is unable to move vertically then bottom cam 64 is unable to rotate the 90° necessary for the slot portion 76 to allow the pin 74 and bottom drawer 5 to continue toward the open position. Consequently, the bottom drawer is effectively locked.

Though the above description describes a two drawer system, it is understood that the present invention can be applied to three or more drawers. In such drawer systems, when a particular drawer is opened that drawer's cam and lug will rotate to a locking position which prevents all locking bars below the lug from moving from a first position to a second position. The cams for drawers below the opened drawer are prevented from moving their respective locking bars and, thus, the drawers below the opened drawer are locked in the closed position.

Besides preventing all drawers below the opened drawer from being opened, all drawers above the opened drawer are locked as well. This is understood upon reviewing FIGS. 2 and 6. The locking bars for each drawer or shelf have a combined length which is less than the height of side wall 8. Thus, there is a space between the top of the cabinet 2 and the top flange 28 of top locking bar 24 when locking bar 24 is located at the bottom of slots 36. The space has a vertical length of approximately 0.430". Consequently, when a drawer is opened all locking bars above the drawer are able to vertically move upward a distance of approximately 0.425" leaving a space of approximately 0.005" from the top of the cabinet. Since such a space is less than the width of lug 70 of the cams associated with the locking bars above the opened drawer, those lugs 70 are unable to move between the locking bars. The inability of the lugs 70 to move the locking bars prevents the cams to rotate and, thus, the drawers associated with the immovable cams and above the opened drawer are locked in the closed position.

Another aspect of the present invention is shown in FIGS. 2 and 7. FIGS. 2 and 7 illustrate a second locking mechanism 78 which moves from a first position C to a locking position D (FIG. 7). At position C, top locking bar 24 and bottom locking bar 46 are each able to move vertically from a first position to a second position so that the drawers can be opened and locked as described previously. However, when second locking mechanism 78 moves along a direction approximately 90° with respect to the direction of movement of top locking bar 24 to locking position D, the top locking bar 24 and bottom locking bar 46 are each prevented from moving from a first position to a second position. As mentioned previously, when a locking bar is unable to move the corresponding drawers are locked in the closed position. Thus, when locking mechanism moves to locking position D all of the drawers are effectively locked.

Second locking mechanism 78 is approximately rectangular in shape. Locking mechanism 78 comprises slots 80 which engage pins 82 of right side surface 8. Pins 82 are located approximately 0.625" from the top of surface 8 and approximately 0.264" and 2.268" from the front of surface 8. A spring 84 is attached to both the locking mechanism 78 and surface 8 as shown in FIGS. 2 and 7. Spring 84 forces locking mechanism 78 to position C in which pins 82 engage the closed ends 86 of slots 80. At position C, a tab 88 of locking mechanism 78 is positioned over notch 27 of locking bar 24. Furthermore, a notch 90 of locking mechanism 78 is spaced above top flange 28 of locking bar 24. At position C, the notch 90 allows the top and bottom locking bars 24 and 46 to move from a first position to a second position and, thus, operate as described previously.

Locking mechanism 78 is moved to locking position D (dashed lines), by having the locking mechanism ride along a movement mechanism having a ramped surface, such as helical cam activator 92 engaging an inner curved surface 94 of locking mechanism 78. The ramped surface engages the locking mechanism causing the ramped surface and the locking mechanism to move relative to one another. The relative movement is such that the locking mechanism 78 translationally moves a distance which is less than the distance traveled on the ramped surface.

This can be seen in FIG. 7, wherein clockwise rotation of helical cam activator 92 about an axis results in curved surface 94 riding along the ramped cam activator surface such that locking mechanism 78 travels or along the axis to position D. Though the embodiment of FIG. 7 discloses pulling the locking mechanism 78 from right to left towards the door, it is understood that the locking system would work equally well if position C was located to the left of position of position B and one used the cam activator 92 to push locking mechanism 78 away from the door in a left to right manner.

Helical cam activator 92 is made from sturdy material, such as plastic, zinc die cast, aluminum or forged steel. As shown in FIG. 8, activator 92 has a linear surface 96 and a helical ramp surface 98 which rises above the linear surface 96 by approximately ½" within a rotation of approximately 120°. It is understood that other shapes for the ramp surface are possible so that rotation of the activator results in the locking mechanism 78 to ride along the ramp to the locked and unlocked positions.

Activator 92 comprises a cylindrical support 100 which contains an opening 102. Opening 102 receives a bolt 104 which is, connected to key mechanism 106, shown in FIG. 2. Key mechanism 106 is contained in a cylindrical portion 108 of a mounting 110 which is attached to the front surface 20 of top drawer 4. Mounting 110 comprises a rectangular portion 112 having openings 114. Mounting 110 is attached to top drawer 4 via screws inserted through openings 114 and into drawer 4. Mounting 110 preferably is made of a resilient material, such as plastic, zinc die cast, forged steel, die cast aluminum.

With the above-described lock system, one locks all of the closed drawers by inserting key 116 into the key mechanism 96 which is accessible from opening 118 in drawer 4. One then rotates the key 116 clockwise which results in the helical cam activator 84 engaging and moving the lock mechanism 70 to lock position B as described previously.

While the invention has been described with relation to certain presently preferred embodiments, those with skill in this art will recognize other modifications of the invention which will still fall within the scope of the invention, as expressed in the accompanying claims.

We claim:

1. A lock system for a container having a first side wall and a second side wall, said lock system comprising:

a first component;

a first track supporting said first component and defining a path for said first component to move from a closed position to an open position;

a first locking bar movable along a direction of movement from a first position to a second position allowing said first component to move along said first track to said open position;

a second component;

a second track supporting said second component and defining a path for said second component to move from a closed position to an open position;

a second locking bar movable from a first position to a second position allowing said second component to move along said second track to said open position;

a locking mechanism engaging a ramp surface of a moving mechanism that rotates about an axis so that the rotating ramp surface causes said locking mechanism to move a first distance substantially parallel to said axis to a locking position so as to prevent said first locking bar from moving from said first position to said second position and preventing said second locking bar from moving from said first position to said second position whereby said first component and said second component are each locked in said closed position.

2. The lock system of claim 1, wherein said first component comprises a drawer.

3. The lock system of claim 2, wherein said second component comprises a drawer.

4. The lock system of claim 1, wherein said first component comprises a planar surface.

5. The lock system of claim 4, wherein said second component comprises a planar surface.

6. The lock system of claim 1, wherein said locking mechanism moves from a third position to said locking position, and wherein said locking mechanism at said third position allows said first locking bar to move from said first position to said second position so that said first component moves to said open position.

7. The lock system of claim 6, wherein said locking mechanism comprises a tab to engage said first locking bar at said locking position preventing said first locking bar from moving from said first position to said second position resulting in said first component locking.

8. The lock system of claim 7, wherein said locking mechanism comprises a notch allowing said first locking bar to move from said first position to said second position when said locking mechanism is located at said third position.

9. The lock system of claim 1, comprising a helical cam activator having said ramp surface and used to move said locking mechanism to said locking position.

10. A lock system for a container having a first side wall and a second side wall, said lock system comprising:

a first component:

a first track supporting said first component and defining a path for said first component to move from a closed position to an open position;

a first locking bar movable along a direction of movement from a first position to a second position allowing said first component to move along said first track to said open position;

a second component;

a second track supporting said second component and defining a path for said second component to move from a closed position to an open position;

a second locking bar movable from a first position to a second position allowing said second component to move along said second track to said open position;

a locking mechanism movable a first distance relative to a ramp surface of a moving mechanism to a locking position so as to prevent said first locking bar from moving from said frist position to said second position and preventing said second locking bar from moving from said frist position to said second position whereby said first component and said second component are each locked in said closed position, wherein the relative movement is such that said locking mechanism translationally moves a second distance which is less than the first distance traveled by said locking mechanism on the ramp surface.

11. The lock system of claim 10, wherein said first component comprises a drawer.

12. The lock system of claim 10, wherein said first component comprises a planar surface.

13. The lock system of claim 10, wherein said locking mechanism moves from a third position to said locking position, and wherein said locking mechanism at said third position allows said first locking bar to move from said first position to said second position so that said first component moves to said open position.

14. The lock system of claim 13, wherein said locking mechanism comprises a tab to engage said first locking bar at said locking position preventing said first locking bar from moving from said first position to said second position resulting in said first component locking.

15. The lock system of claim 14, wherein said locking mechanism comprises a notch allowing said first locking bar to move from said first position to said second position when said locking mechanism is located at said third position.

16. The lock system of claim 10, comprising a helical cam activator to translationally move said locking mechanism.

17. A lock system for a container having a first side wall and a second side wall, said lock system comprising:

a first component;

a first track supporting said first component and defining a path for said first component to move from a closed position to an open position;

a first locking bar movable along a direction of movement from a first position to a second position allowing said first component to move along said first track to said open position;

a second component;

a second track supporting said second component and defining a path for said second component to move from a closed position to an open position;

a second locking bar movable from a first position to a second position allowing said second component to move along said second track to said open position;

a locking mechanism movable a first distance relative to a rotating ramp surface of a moving mechanism to a locking position so as to prevent said first locking bar from moving from said first position to said second position and preventing said second locking bar from moving from said first position to said second position whereby said first component and said second component are each locked in said closed position, wherein said locking mechanism moves along a direction of movement approximately 90° with respect to the direction of movement of said first locking bar and said ramp surface rotates about an axis that is substantially parallel to said direction of movement of said locking mechanism.

18. The lock system of claim 17, wherein said locking mechanism moves from a third position to said locking position, and wherein said locking mechanism at said third position allows said first locking bar to move from said first position to said second position so that said first component moves to said open position.

19. The lock system of claim 18, wherein said locking mechanism comprises a tab to engage said first locking bar at said locking position preventing said first locking bar from moving from said first position to said second position resulting in said first component and said second component locking.

20. The lock system of claim 19, wherein said locking mechanism comprises a notch allowing said first locking bar to move from said first position to said second position when said locking mechanism moves to said third position.

21. The lock system of claim 18, comprising a helical cam activator having said ramp surface and used to move said locking mechanism from said third position to said locking position.

22. The lock system of claim 17, comprising a helical cam activator having said ramp surface and used to move said locking mechanism along said direction approximately 90° with respect to the direction of movement of said first locking bar.

23. A lock system for a container having a first side wall and a second side wall, said lock system comprising:

a first component;

a first track supporting said first component and defining a path for said first component to move from a closed position to an open position;

a first locking bar movable along a direction of movement from a first position to a second position allowing said first component to move along said first track to said open position;

a second component:

a second track supporting said second component and defining a path for said second component to move from a closed position to an open position;

a second locking bar movable from a first position to a second position allowing said second component to move along said second track to said open position;

a locking mechanism movable a first distance relative to a ramp surface of a moving mechanism to a locking position so as to prevent said first locking bar from moving from said frist position to said second position and preventing said second locking bar from moving from said frist position to said second position whereby said first component and said second component are each locked in said closed position; and a helical cam activator having said ramp surface to move said locking mechanism.

24. A method of locking a first component and a second component movable from a closed position to an open position in a container having a first side wall and a second side wall, said method of locking comprising the steps of:

providing a first locking bar movable along a direction of movement from a first position to a second position allowing said first component to move from said closed position to said open position;

providing a second locking bar movable from a first position to a second position allowing said second component to move from said closed position to said open position;

providing a locking mechanism movable to a locking position so as to prevent said first locking bar from moving from said first position to said second position and preventing said second locking bar from moving from said first position to said second position whereby said first component and said second component are each locked in said closed position;

engaging said locking mechanism with a ramp surface of a moving mechanism that rotates about an axis so that the rotating ramp surface causes said locking mechanism to move a first distance substantially parallel to said axis to said locking position.

25. The method of locking of claim 24, wherein said first component comprises a drawer.

26. The method of locking of claim 25, wherein said second component comprises a drawer.

27. The method of locking of claim, 24, wherein said first component comprises a planar surface.

28. The method of locking of claim 27, wherein said second component comprises a planar surface.

29. A method of locking a first component and a second component movable from a closed position to an open position in a container having a first side wall and a second side wall, said method of locking comprising the steps of:

providing a first locking bar movable along a direction of movement from a first position to a second position allowing said first component to move from said closed position to said open position;

providing a second locking bar movable from a first position to a second position allowing said second component to move from said closed position to said open position:

providing a locking mechanism movable to a locking position so as to prevent said first locking bar from moving from said frist position to said second position and preventing said second locking bar from moving from said frist position to said second position whereby said first component and said second component are each locked in said closed position; and moving said locking mechanism a first distance relative to a ramp surface of a moving mechanism so as to move said locking mechanism to said locking position, wherein the relative movement is such that said locking mechanism translationally moves a second distance which is less than the first distance traveled by said locking mechanism on the ramp surface.

30. A method of locking a first component and a second component movable from a closed position to an open position in a container having a first side wall and a second side wall, said method of locking comprising the steps of: providing a first locking bar movable along a direction of movement from a first position to a second position allowing said first component to move from said closed position to said open position;

providing a second locking bar movable from a first position to a second position allowing said second component to move from said closed position to said open position;

providing a locking mechanism movable to a locking position so as to prevent said first locking bar from moving from said first position to said closed position and preventing said second locking bar from moving from said first position to said second position whereby said first component and said second component are each locked in said closed position; and moving said locking mechanism a first distance relative to a rotating ramp surface of a moving mechanism so as to move said locking mechanism to said locking position, wherein said locking mechanism moves along a direction of movement approximately 90° with respect to the direction of movement of said first locking bar and said ramp surface rotates about an axis that is substantially parallel to said direction of movement of said locking mechanism.

31. The method of locking of claim 30, wherein said locking mechanism moves from a third position to said locking position, and wherein said locking mechanism at said third position allows said first locking bar to move from said first position to said second position so that said first component moves to said open position.

32. The method of locking of claim 31, wherein said locking mechanism comprises a tab to engage said first locking bar at said locking position preventing said first locking bar from moving from said first position to said second position resulting in said first component and said second component locking.

33. The method of locking of claim 32, wherein said locking mechanism comprises a notch allowing said first locking bar to move from said first position to said second position when said locking mechanism moves to said third position.

34. The method of locking of claim 30, comprising the step of activating a helical cam activator having said ramp surface and used to move said locking mechanism along said direction approximately 90° with respect to the direction of movement of said first locking bar.

35. The method of locking of claim 30 comprising the step of activating a helical cam activator having said ramp surface and used to move said locking mechanism to said locking position.

36. A method of locking a first component and a second component movable from a closed position to an open position in a container having a first side wall and a second side wall, said method of locking comprising the steps of:

providing a first locking bar movable along a direction of movement from a first position to a second position allowing said first component to move from said closed position to said open position;

providing a second locking bar movable from a first position to a second position allowing said second component to move from said closed position to said open position;

providing a locking mechanism movable to a locking position so as to prevent said first locking bar from moving from said first position to said second position and preventing said second locking bar from moving from said first position to said second position whereby said first component and said second component are each locked in said closed position; and activating a helical cam activator having a ramp surface to move said locking mechanism; and moving said locking mechanism a first distance relative to said ramp surface so as to move said locking mechanism to said locking position.

37. A lock system for a container having a first side wall and a second side wall, said lock system comprising:

a first component;

a first track supporting said first component and defining a path for said first component to move from a closed position to an open position;

a first locking bar movable along a direction of movement from a first position to a second position allowing said first component to move along said first track to said open position;

a locking mechanism engaging a ramp surface of a moving mechanism that rotates about an axis so that the ramp surface causes said locking mechanism to move a first distance substantially parallel to said axis to a locking position so as to prevent said first locking bar from moving from said first position to said second position, whereby said first component is locked in said closed position.

38. The lock system of claim 37, wherein said first component comprises a drawer.

39. The lock system of claim 37, wherein said first component comprises a planar surface.

40. The lock system of claim 37, wherein said locking mechanism moves from a third position to said locking position, and wherein said locking mechanism at said third position allows said first locking bar to move from said first position to said second position so that said first component moves to said open position.

41. The lock system of claim 40, wherein said locking mechanism comprises a tab to engage said first locking bar at said locking position preventing said first locking bar from moving from said first position to said second position resulting in said first component locking.

42. The lock system of claim 40, wherein said locking mechanism comprises a notch allowing said first locking bar to move from said first position to said second position when said locking mechanism is located at said third position.

43. The lock system of claim 37, said ramp surface comprising a helical cam activator to move said locking mechanism to said locking position.

44. A lock system for a container having a first side wall and a second side wall, said lock system comprising:

a first component;

a first track supporting said first component and defining a path for said first component to move from a closed position to an open position;

a first locking bar movable along a direction of movement from a first position to a second position allowing said first component to move along said first track to said open position;

a locking mechanism movable a first distance relative to a ramp surface of a moving mechanism to a locking position so as to prevent said first locking bar from moving from said frist position to said second position, whereby said first component is locked in said closed position, wherein the relative movement is such that said locking mechanism translationally moves a second distance which is less than the first distance traveled by said locking mechanism on the ramp surface.

45. The lock system of claim 44, wherein said first component comprises a drawer.

46. The lock system of claim 44, wherein said first component comprises a planar surface.

47. The lock system of claim 44, wherein said locking mechanism moves from a third position to said locking position, and wherein said locking mechanism at said third position allows said first locking bar to move from said first position to said second position so that said first component moves to said open position.

48. The lock system of claim 47, wherein said locking mechanism comprises a tab to engage said first locking bar at said locking position preventing said first locking bar from moving from said first position to said second position resulting in said first component locking.

49. The lock system of claim 48, wherein said locking mechanism comprises a notch allowing said first locking bar to move from said first position to said second position when said locking mechanism is located at said third position.

50. The lock system of claim 44, said ramps surface comprising a helical cam activator to move said locking mechanism to said locking position.

51. A lock system for a container having a first side wall and a second side wall, said lock system comprising:

a first component;

a first track supporting said first component and defining a path for said first component to move from a closed position to an open position;

a first locking bar movable along a direction of movement from a first position to a second position allowing said first component to move along said first track to said open position;

a locking mechanism movable a first distance relative to a rotating ramp surface of a moving mechanism to a locking position so as to prevent said first locking bar from moving from said first position to said second position, whereby said first component is locked in said closed position, wherein said locking mechanism moves along a direction of movement approximately 90° with respect to the direction of movement of said first locking bar and said ramp surface rotates about an axis that is substantially parallel to said direction of movement of said locking mechanism.

52. The lock system of claim 51, wherein said first component comprises a drawer.

53. The lock system of claim 51, wherein said first component comprises a planar surface.

54. The lock system of claim 51, wherein said locking mechanism moves from a third position to said locking position, and wherein said locking mechanism at said third position allows said first locking bar to move from said first position to said second position so that said first component moves to said open position.

55. The lock system of claim 54, wherein said locking mechanism comprises a tab to engage said first locking bar at said locking position preventing said first locking bar from moving from said first position to said second position resulting in said first component locking.

56. The lock system of claim 54, wherein said locking mechanism comprises a notch allowing said first locking bar to move from said first position to said second position when said locking mechanism is located at said third position.

57. The lock system of claim 51, said ramp surface comprising a helical cam activator to move said locking mechanism to said locking position.

58. A lock system for a container having a first side wall and a second side wall, said lock system comprising:

a first component;

a first track supporting said first component and defining a path for said first component to move from a closed position to an open position;

a first locking bar movable along a direction of movement from a first position to a second position allowing said first component to move along said first track to said open position;

a locking mechanism movable a first distance relative to a ramp surface of a moving mechanism to a locking position so as to prevent said first locking bar from moving from said first position to said second position whereby said first component is locked in said closed position; and a helical cam activator having said ramp surface and used to move said locking mechanism.

59. The lock system of claim 58, wherein said helical cam activator moves said locking mechanism to said locking position.

60. The lock system of claim 58, wherein said first component comprises a drawer.

61. The lock system of claim 58, wherein said first component comprises a planar surface.

62. The lock system of claim 58, wherein said locking mechanism moves from a third position to said locking position, and wherein said locking mechanism at said third position allows said first locking bar to move from said first position to said second position so that said first component moves to said open position.

63. The lock system of claim 62, wherein said locking mechanism comprises a tab to engage said first locking bar at said locking position preventing said first locking bar from moving from said first position to said second position resulting in said first component locking.

64. The lock system of claim 63, wherein said locking mechanism comprises a notch allowing said first locking bar to move from said first position to said second position when said locking mechanism is located at said third position.

65. A method of locking a first component movable from a closed position to an open position in a container having a first side wall and a second side wall, said method of locking comprising the steps of: providing a first locking bar movable along a direction of movement from a first position to a second position allowing said first component to move from said closed position to said open position;

providing a locking mechanism movable to a locking position so as to prevent said first locking bar from moving from said first position to said second position, whereby said first component is locked in said closed position;

engaging said locking mechanism with a ramp surface of a moving mechanism that rotates about an axis causing said locking mechanism to move a first distance substantially parallel to said axis to said locking position.

66. The method of locking of claim 65, wherein said first component comprises a drawer.

67. The method of locking of claim 65, wherein said first component comprises a planar surface.

68. The method of locking of claim 65, wherein said locking mechanism moves from a third position to said locking position, and wherein said locking mechanism at said third position allows said first locking bar to move from said first position to said second position so that said first component moves to said open position.

69. The method of locking of claim 68, wherein said locking mechanism comprises a tab to engage said first locking bar at said locking position preventing said first locking bar from moving from said first position to said second position resulting in said first component locking.

70. The method of locking of claim 69, wherein said locking mechanism comprises a notch allowing said first locking bar to move from said first position to said second position when said locking mechanism is located at said third position.

71. The method of locking of claim 65, wherein said engaging step is performed by a helical cam activator having said ramp surface and engaging said locking mechanism.

72. A method of locking a first component movable from a closed position to an open position in a container having a first side wall and a second side wall, said method of locking comprising the steps of:

providing a first locking bar movable along a direction of movement from a first position to a second position allowing said first component to move from said closed position to said open position;

providing a locking mechanism movable to a locking position so as to prevent said first locking bar from moving from said first position to said second position, whereby said first component is locked in said closed position; and moving said locking mechanism a first distance relative to a ramp surface of a moving mechanism so as to move said locking mechanism to said locking position, wherein the relative movement is such that said locking mechanism translationally moves a second distance which is less than the first distance traveled by said locking mechanism on the ramped surface.

73. The method of locking of claim 72, wherein said first component comprises a drawer.

74. The method of locking of claim 72, wherein said first component comprises a planar surface.

75. The method of locking of claim 72, wherein said locking mechanism moves from a third position to said locking position, and wherein said locking mechanism at said third position allows said first locking bar to move from said first position to said second position so that said first component moves to said open position.

76. The method of locking of claim 75, wherein said locking mechanism comprises a tab to engage said first locking bar at said locking position preventing said first locking bar from moving from said first position to said second position resulting in said first component locking.

77. The method of locking of claim 76, wherein said locking mechanism comprises a notch allowing said first locking bar to move from said first position to said second position when said locking mechanism is located at said third position.

78. The method of locking of claim 72, wherein said moving step is performed by a helical cam activator having said ramp surface and engaging said locking mechanism.

79. A method of locking a first component movable from a closed position to an open position in a container having a first side wall and a second side wall, said method of locking comprising the steps of:

providing a first locking bar movable along a direction of movement from a first position to a second position allowing said first component to move from said closed position to said open position;

providing a locking mechanism movable to a locking position so as to prevent said first locking bar from moving from said first position to said second position, whereby said first component is locked in said closed position; and moving said locking mechanism a first distance relative to a rotating ramp surface of a moving mechanism so as to move said locking mechanism to said locking position, wherein said locking mechanism moves along a direction of movement approximately 90° with respect to the direction of movement of said first locking bar and said ramp surface rotates about an axis that is substantially parallel to said direction of movement of said locking mechanism.

80. The method of locking of claim 79, wherein said first component comprises a drawer.

81. The method of locking of claim 79, wherein said first component comprises a planar surface.

82. The method of locking of claim 79, wherein said locking mechanism moves from a third position to said locking position, and wherein said locking mechanism at said third position allows said first locking bar to move from said first position to said second position so that said first component moves to said open position.

83. The method of locking of claim 82, wherein said locking mechanism comprises a tab to engage said first locking bar at said locking position preventing said first locking bar from moving from said first position to said second position resulting in said first component locking.

84. The method of locking of claim 83, wherein said locking mechanism comprises a notch allowing said first locking bar to move from said first position to said second position when said locking mechanism is located at said third position.

85. The method of locking of claim 79, wherein said moving step is performed by a helical cam activator having said ramp surface and engaging said locking mechanism.

86. A method of locking a first component movable from a closed position to an open position in a container having a first side wall and a second side wall, said method of locking comprising the steps of:

providing a first locking bar movable along a direction of movement from a first position to a second position allowing said first component to move from said closed position to said open position;

providing a locking mechanism movable to a locking position so as to prevent said first locking bar from moving from said first position to said second position, whereby said first component is locked in said closed position;

activating a helical cam activator of a ramp surface to move said locking mechanism; and moving said locking mechanism a first distance relative to said a ramp surface so as to move said locking mechanism to said locking position.

87. The method of locking of claim 86, said helical cam activator moves said locking mechanism to said locking position.

88. The method of locking of claim 86, wherein said first component comprises a drawer.

89. The method of locking of claim 86, wherein said first component comprises a planar surface.

90. The method of locking of claim 86, wherein said locking mechanism moves from a third position to said locking position, and wherein said locking mechanism at said third position allows said first locking bar to move from said first position to said second position so that said first component moves to said open position.

91. The method of locking of claim 90, wherein said locking mechanism comprises a tab to engage said first locking bar at said locking position preventing said first locking bar from moving from said first position to said second position resulting in said first component locking.

92. The method of locking of claim 91, wherein said locking mechanism comprises a notch allowing said first locking bar to move from said first position to said second position when said locking mechanism is located at said third position.

* * * * *

UNITED STATES PATENT AND TRADEMARK OFFICE

CERTIFICATE OF CORRECTION

PATENT NO. : 5,567,027
DATED : October 22, 1996
INVENTOR(S) : McClung et al.

It is certified that error appears in the above-identified patent and that said Letters Patent is hereby corrected as shown below:

In the Claims

In Claim 10, line 21, delete "frist" and replace with --first--.

In Claim 10, line 23, delete "frist" and replace with --first--.

In Claim 23, line 11, delete ":" and replace with --;--.

In Claim 23, line 21, delete "frist" and replace with --first--.

In Claim 23, line 23, delete "frist" and replace with --first--.

In Claim 27, line 1, immediately after "claim" delete ",".

In Claim 29, line 12, delete ":" and replace with --;--.

In Claim 29, line 15, delete "frist" and replace with --first--.

In Claim 29, line 17, delete "frist" and replace with --first--.

UNITED STATES PATENT AND TRADEMARK OFFICE

CERTIFICATE OF CORRECTION

PATENT NO. : 5,567,027
DATED : October 22, 1996
INVENTOR(S) : McClung et al.

It is certified that error appears in the above-identified patent and that said Letters Patent is hereby corrected as shown below:

In the Claims (cont'd)

In Claim 44, line 14, delete "frist" and replace with --first--.

In Claim 86, line 16, delete the second occurrence of "a".

Signed and Sealed this

Twenty-fourth Day of March, 1998

*Attest:*

Bruce Lehman

BRUCE LEHMAN

*Attesting Officer*

*Commissioner of Patents and Trademarks*